United States Patent [19]

Mahoney

[11] Patent Number: 4,899,198

[45] Date of Patent: Feb. 6, 1990

[54] DUAL PURPOSE CLEANING APPARATUS

[75] Inventor: Gregory Mahoney, Fairport, N.Y.

[73] Assignee: Eastman Kodak Company, Rochester, N.Y.

[21] Appl. No.: 246,707

[22] Filed: Sep. 20, 1988

Related U.S. Application Data

[63] Continuation-in-part of Ser. No. 139,226, Dec. 29, 1987, abandoned.

[51] Int. Cl.[4] ..... G03G 15/21

[52] U.S. Cl. ..... 355/297; 355/271

[58] Field of Search ..... 355/15, 3 R, 3 T R, 355/4, 271, 296, 297; 118/652

[56] References Cited

U.S. PATENT DOCUMENTS

| | | | |
|---|---|---|---|
| 3,792,925 | 2/1974 | Milligan et al. | 355/300 |
| 3,893,761 | 7/1975 | Buchan et al. | 355/3 R |
| 4,026,648 | 5/1977 | Takahashi | 355/299 |
| 4,058,850 | 11/1977 | Sheikh | 355/208 X |
| 4,439,035 | 3/1984 | Landa | 355/307 |
| 4,449,241 | 5/1984 | Nakayama | 355/15 X |
| 4,453,820 | 6/1984 | Suzuki | 355/279 |
| 4,588,279 | 5/1986 | Fukuchi et al. | 355/3 T R |

FOREIGN PATENT DOCUMENTS

| | | | |
|---|---|---|---|
| 02335898 | 8/1987 | European Pat. Off. . | |
| 59-185365 | 10/1984 | Japan | 355/297 |
| 88-00106 | 7/1988 | World Int. Prop. O. . | |

*Primary Examiner*—Joan H. Pendegrass

*Attorney, Agent, or Firm*—Tallam I. Nguti

[57] ABSTRACT

In a copier or printer utilizing a photoconductive member and an image transfer member in image-transfer relationship with the photoconductor, a single cleaning apparatus is movable into a first position for cleaning the photoconductor and into a second position for cleaning the image transfer member. The cleaning apparatus includes an electrically biased roller, that is urged and held into the first cleaning position by a tension spring, and that is movable by a solenoid into the second cleaning position.

10 Claims, 2 Drawing Sheets

DUAL PURPOSE CLEANING APPARATUS

This is a continuation-in-part of U.S. Application Ser. No. 139,226, entitled "Dual Purpose Cleaning Apparatus," filed Dec. 29, 1987, in the name of Gregory P. Mahoney.

BACKGROUND OF THE INVENTION

This invention relates to an apparatus for cleaning residual toner from the surface of a component of an electrostatographic copier or printer. More particularly, the invention relates to such a cleaning apparatus for cleaning two different image transfer-related surfaces within the same copier or printer, as for example, the surface of the photoconductor and the surface of a transfer roll or of an image-bearing intermediate transfer member.

In the electrophotographic type of electrostatographic copiers and printers, for example, an image formed on an image-bearing surface of a reusable photoconductor is developed with toner particles and then directly transferred to a receiver, such as a sheet of paper. As disclosed, for example, in U.S. Pat. No. 4,058,850, such direct transfer to a copy sheet may be accomplished by means of a (copy sheet support) transfer roll. In such a case, the copy sheet or receiver is attached in registration to the surface of the transfer roll and rotated with the transfer roll two or more times to receive two or more toned components of a multicolor image, one at a time, from successive image frames of the photoconductor. In this manner, the multicolor image is being composed directly on the copy sheet or receiver, which is thereafter detached from the transfer roll for fusing.

Alternatively, the developed image, that is, the toned component of a multicolor image, may first be transferred from the photoconductor to a reusable image-bearing intermediate member before it is then transferred from such member to the copy sheet or receiver. When initial transfer from the photoconductor is to such an intermediate member, the image may be held on the intermediate member for a number of revolutions before it is thereafter transferred to the receiver. During such revolutions, additional images, are transferred onto the initial image already on the intermediate member. These additional images are normally portions of the same original image, and are each usually developed with toner particles of a different color, thereby resulting in a multiple color final image on the intermediate member, which is then transferred to the receiver for fusing.

As is well recognized in the art, the quality of copies, that is, of the fused images produced on the receiver, and of the receiver itself, depends significantly on the cleanliness of the image-bearing surface of the photoconductor and of the surface of such image transfer members. It is desirable therefore to clean residual toner and other particles remaining from these reusable surfaces after image transfer.

For such cleaning, various types of apparatus are well known in the art. Typically, these apparatus each employ a mechanical cleaning element such as a brush, a blade or a roller, and each is dedicated to cleaning just one surface. To improve the cleaning effectiveness of these types of apparatus, specific features such as a vacuum system or a secondary cleaning element are usually added. The addition of such features, unfortunately, tends to make these apparatus bulky and costly. Such bulky and expensive cleaning apparatus are especially undesirable in small and low cost copiers and printers. Space inside these types of copiers and printers because space inside these types of copiers and printers is very limited. Because of the limited space, and of a trend towards small and low cost copiers and printers, there is a need to develop alternatives to multiple, bulky and expensive dedicated cleaning apparatus in such copiers and printers.

SUMMARY OF THE INVENTION

It is, therefore, the object of the present invention to provide a simple and effective apparatus that can clean two different image transfer-related surfaces in a copier or printer.

In accordance with the present invention, a cleaning apparatus is provided for cleaning residual toner and other particles from the moving image-bearing surface of the photoconductor of an electrostatographic copier or printer. The same apparatus can also clean residual toner and other particles from the moving surface of an image transfer member, such as a transfer roll or an image-bearing intermediate transfer member.

The cleaning apparatus of the present invention comprises a cleaning roller that is electrically biased to a polarity opposite that of the toner particles being removed. The roller is mounted on a shaft and is movable into a first position for cleaning the photoconductor, and into a second position for cleaning the image transfer member. A pivotable holding means moves the roller into its first and second positions. A blade scrapes the waste toner from the roller, and a container collects such waste toner. A tension spring and a solenoid are provided for moving the holding means into the first and second cleaning positions. The action of the solenoid is controlled by a logic and control unit.

BRIEF DESCRIPTION OF THE DRAWINGS

In the detailed description of the preferred embodiment of the invention described below, reference is made to the accompanying drawings in which.

DETAILED DESCRIPTION OF THE PREFERRED EMBODIMENT

Figure 1:
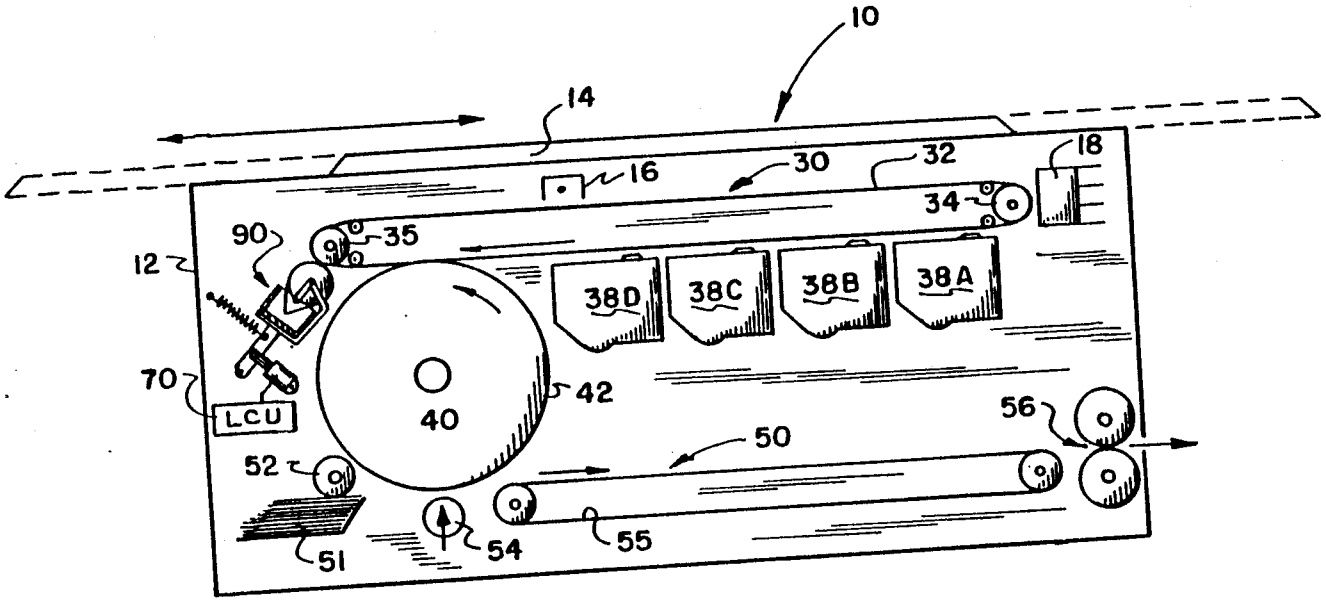
FIG. 1 is a schematic view of an electrostatographic copier or printer having a photoconductor and an image transfer member, with the cleaning apparatus of the present invention in position for cleaning the photoconductor.

Referring now to the drawings in detail, an electrostatographic copier or printer 10 includes a housing 12, a document handling platen 14, a primary charger 16 and an electronic printhead 18. The copier or printer 10 also includes a photoconductor 30 with four development stations 38A, 38B, 38C and 38D, an image transfer member 40 having a surface 42, a copy sheet handling system 50, and a logic and control unit 70. The cleaning apparatus of the present invention is denoted generally as 90.

The photoconductor 30 is a wide flexible endless web trained about rollers 34, 35. It is divided into several image frames and thus is capable of holding up several different images at a time. On the other hand, the image transfer member 40, as illustrated, is only as large as one image frame. The member 40, as shown, is a rigid drum contacting and extending across the entire width of the photoconductor 30. It also can be an endless flexible web. Both the photoconductor 30 and the member 40 are electrically biased, creating an electrical field that enhances toner particle transfer from the photoconductor 30 towards the member 40 which can be an image-bearing intermediate transfer member or merely a transfer roll for supporting a copy sheet. Therefore, images transferred thus may be to the member 40 as an intermediate transfer member for subsequent transfer to a copy sheet 51, or directly to the copy sheet 51 attached to, and rotated with, the member 40 when it is used as a transfer roll.

The copy sheet 51 is fed from a stack of such sheets by a roller 52 and is urged into registered contact with the member 40, for example, by the roller 54. When the member 40 is a (copy sheet support) transfer roll, the sheet 51 is gripped to the surface 42 and rotated in engagement with the photoconductor to receive, in superimposed registration, successive toned images from the photoconductor thus forming a multicolor image on the copy sheet. When the member 40 is an image-bearing intermediate transfer member that rotates in direct engagement with the photoconductor, successive toned images on the photoconductor are first transferred one at a time in superimposed registration to the image-bearing surface 42, and then retransferred all at once to the copy sheet 51 when it contacts the member 40. In either case, the copy sheet 51 after receiving the composed image is thereafter moved by a sheet transfer system 55 to a fusing station 56 where the image is fused to form the copy. It should be noted that the photoconductor 30 can also be a rigid drum, and that when the member 40 is an image-bearing intermediate member, it can also be in the form of a flexible web that is trained about a set of rollers.

The cleaning apparatus 90 of the present invention is located downstream of the nip formed by the photoconductor 30 and the member 40. There, the apparatus 90 is mounted to the housing 12, and is movable into a first position for cleaning the surface 32 of the photoconductor 30, and into a second position for cleaning the surface 42 of the member 40.

The apparatus 90 comprises a cleaning roller 91 that is mounted on a shaft 93. The roller 91 is as long as the member 40 and the width of the photoconductor 30. The roller 91 preferably has a soft resilient surface 92 for removing toner particles from the surface being cleaned. The roller 91 is electrically (DC) biased from a source 83 to a polarity opposite that of the toner particles. This enhances toner particle removal by electrical attraction.

An elongate member 94 extends along the length of the roller 91. The member 94 has an arcuate portion 97 that is spaced from and that generally conforms to an arcuate portion of the roller 91. A pair of blades 98, 99 on side edges of member 94 contact and clean the surface 92 of roller 91. Blade 98 cleans the surface 92 when the surface 92 is rotating in the direction shown by arrow 95A, and the blade 99 cleans the surface 92 when the surface 92 is rotating in the direction shown by arrow 95B.

Figure 2:
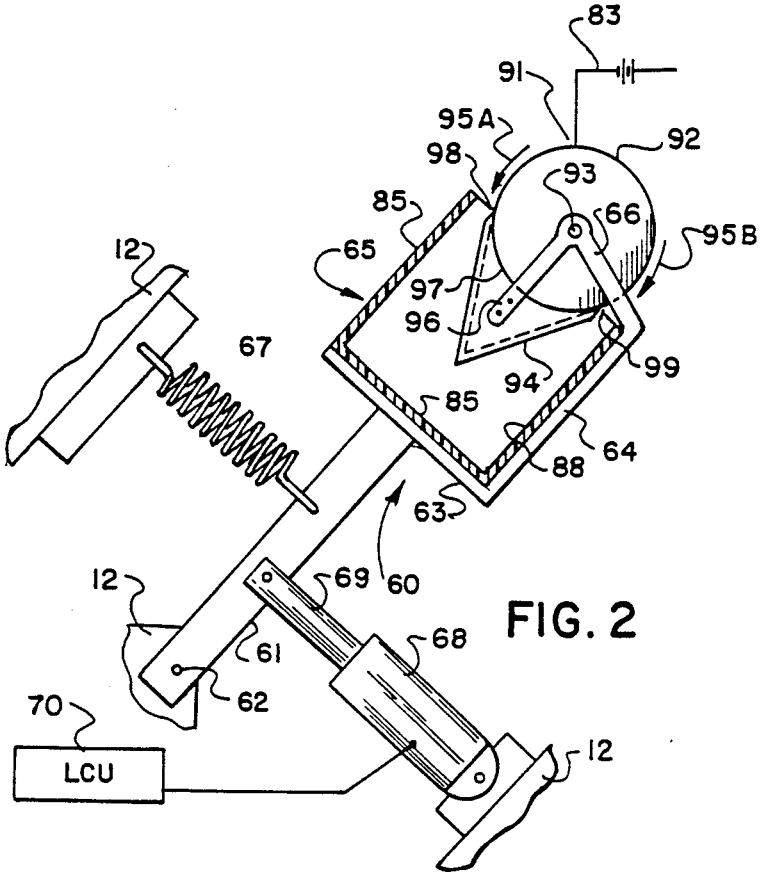
FIG. 2 is an enlarged elevational view of the cleaning apparatus of the present invention including its tension spring and solenoid.

A holder generally designated 60 comprises one or more arms 61 connected at one end to housing 12 by pivots 62 (FIG. 2). The other end of each arm 61 supports a wall 63. Another wall 64 projects upwardly from wall 63. A bracket 66 at each end of wall 64 rotatably supports the shaft 93 of roller 91. Similarly, other brackets 96 at each end of wall 64 supports member 94 from the bracket 66.

A removable container 65 for collecting the waste toner, is located directly underneath member 94 and blades 98 and 99. The container 65 has a base 85 and sides 87, 88. Base 85 sits on and is latchable to the wall 63, and side 88 rests against the wall 64. The container 65 is open at the top for receiving toner particles scraped by the blades 98, 99 from the roller 91. Container 65 can be loaded into and removed from the holder 60 through the open left side of the holder (as viewed in FIG. 2) or through an opening (not shown) in one end of the holder.

Figure 3:
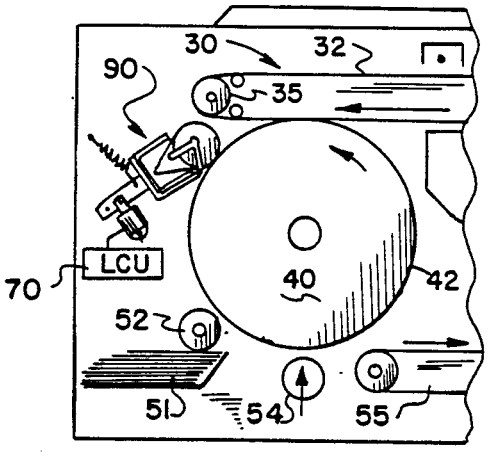
FIG. 3 is an elevational view of the present invention showing its tension spring and solenoid in position for cleaning the image transfer related member.

A tension spring 67 and a solenoid 68 are each separately connected to the housing 12 and to the arm 61 of the holder 60. The spring 67 and solenoid 68 cooperate to move the roller 91 into first and second cleaning positions illustrated in FIGS. 1 and 3. More specifically, the tension spring 67 continuously urges holder 60 and roller 91 into the position shown in FIG. 1 where the roller contacts and cleans surface 32. When actuated, the piston 69 of the solenoid 68 moves arm 61, and hence the holder 60 and the roller 51, against the force of spring 67 into the position shown in FIG. 3 where the roller contacts and cleans surface 42 of member 40. When the solenoid 68 is deactuated, the tension spring 67 returns the arm 61 and hence the holder 60 and the roller 51 to the first position.

A logic and control unit (LCU) 70 controls the operation of copier or printer 10 in preprogrammed sequence, as known in the art. The LCU 70 is connected to and controls the actuation and deactuation of the solenoid 68 at the appropriate time in the machine cycle.

The operation of the cleaning apparatus of the present invention will now be described.

With the photoconductor 30 moving clockwise about the rollers 34, 35, a latent image can be formed on a portion of the surface 32. The latent image is then developed using toner particles from one of the development stations 38A, 38B, 38C or 38D. Subsequently, with surface 42 moving in the same direction as surface 32, the toner image is transferred from the surface 32 to the surface 42 or to a copy sheet attached to surface 42 at the point where the two surfaces come into contact. Several toner images can be transferred in this manner in two or more revolutions of the member 40. When member 40 is a copy sheet support transfer roller, a copy sheet 51 is first fed by roller 52 to the surface 42 of member 40 before the images are transferred as above. However, when the member 40 is an image-bearing member, no copy sheet 51 is fed by the roller 52 during such transfers, and the roller 54 is out of contact with the member 40. Only after the several images have been superimposed, composing a final image on the surface 42, is a copy sheet 51 fed by roller 52 to the surface 42 to receive the composed image.

Residual toner particles that may remain on the surfaces 32 and 42 are removed by the cleaning apparatus 90. Normally, the cleaning apparatus 90 is urged towards and held in contact with the surface 32 as shown in FIG. 1 by the spring 67, so that the roller 91 forms a nip with the surface 32. At this time, the solenoid 68 is deactuated.

The surface 32 frictionally engages the roller 91 and drives it in the direction 95A. Within the nip, toner particles on the surface 32 are pressed against the soft resilient surface 92 of the roller 91. The toner particles tend to adhere to the roller surface 92 and to be peeled away from the surface 32. Because the surface 92 is also electrically biased by a polarity opposite that of the toner particles, the particles also are electrically attracted to the surface 92. The residual toner particles on surface 32 are thus effectively removed by the surface 92 as they pass through the nip between the roller 91 and the photoconductor 30. The toner particles transferred thus to surface 92 are subsequently scraped off by the blade 98 which is in contact with the surface 92. The toner particles that are scraped from the surface 92 drop into the container 65 for collection and eventual disposal.

Residual toner and other particles remaining on the surface 42 after the image or copy sheet thereon has been removed are also removed by the cleaning apparatus 90. Since the surface 42 is only the size of a single image frame portion of the surface 32, it can be cleaned in the time it takes to clean a single frame of the surface 32. Therefore, when the surface 42 is to be cleaned, an image is not formed on at least one image frame area of surface 32. To clean the surface 42, the cleaning apparatus 90 is moved into, and held in, nip contact with the surface 42 by the actuation of the solenoid 68. The surface 42 frictionally engages the roller 91 moving it in the direction 95B. Within the nip, the toner particles on the surface 42 are pressed against the soft resilient surface 92 of the roller 91. The toner particles tend to adhere to the surface 92 and to be peeled away from the surface 42. Because the surface 92 is also electrically biased by a polarity opposite that of the toner particles being removed, removal is enhanced by electrical attraction of the particles to the surface 92. The toner particles transferred to surface 92 are subsequently scraped off surface 92 by the blade 99. The particles so scraped off drop into the container 65 for collection and eventual disposal.

Once cleaning of the surface 42 is completed, usually within a single revolution of the member 40, the solenoid 68 is deactuated by the LCU 70. Immediately, the spring 67 again returns the apparatus 90 to its first position against the surface 32, where it again commences to clean the next portion of that surface 32 as it passes out of the nip with the member 40.

An image frame of the surface 32 on which an image is developed must be cleaned after the developed image is transferred and before the image frame receives another latent image. Therefore, roller 91 is normally in contact with surface 32. The roller 91 does not simultaneously clean the surfaces 32 and 42. Also, the trailing edge of a developed image transferred from surface 32 must pass the point where roller 91 contacts surface 42 before the solenoid moves roller 91 into contact with surface 42 in order to avoid damage to the developed image. Therefore, one or more image frames without developed images thereon should be provided on surface 32 when surface 42 is to be cleaned. These undeveloped image frames can be provided by the logic and control unit 70 of apparatus 10.

When member 40 is an image-bearing member with an image-bearing surface 42, the transfer efficiency of images from surface 42 to a sheet 51 is quite high. For this reason, surface 42 may not need to be cleaned after each transfer to sheet 51. The same is true when the member 40 is merely a (copy sheet support) transfer roller with the surface 42 only indirectly coming into contact with toner particles. Accordingly, the logic and control unit 70 can be programmed to effect cleaning of surface 42 after a predetermined number of images have been transferred from surface 32 to a sheet 51 on surface 42 or to surface 42 and then to sheet 51. Alternatively, the cleaning of surface 42 can occur at the end of a copying job, especially when only a relatively few images are produced in order to complete the job.

As is clear from the above description, the present invention provides a simple and effective cleaning apparatus that can clean both the photoconductor and a member such as a transfer roller or an image-bearing intermediate transfer member in a copier or printer. The invention overcomes the need to have two separate, bulky, and expensive cleaning apparatus in such a copier or printer.

Although the invention has been described in detail with particular reference to a preferred embodiment, it will be understood that variations and modifications can be effected within its spirit and scope.

What is claimed is:

1. In an electrostatographic copier or printer that forms toner particle images and transfers them to a copy sheet by utilizing a moving photoconductor and a moving image transfer member in image transfer relationship with the photoconductor, a cleaning apparatus for removing residual particles from the surface of the photoconductor and the surface of the image transfer member, the cleaning apparatus comprising:

(a) a rotatable cleaning roller;

(b) means supporting said roller for movement between (1) a first position wherein the roller is in a position to clean particles from the surface of the photoconductor, and (2) a second position wherein the roller is in a position to clean particles from the surface of the image transfer member, the roller being spaced from the photoconductor surface when it is in its second position;

(c) means for moving the roller between its first and second positions; and (d) means for removing the particles from the cleaning roller.

2. The invention as set forth in claim 1, wherein said roller is rotatable clockwise and counterclockwise.

3. The invention as set forth in claim 1, wherein a container for collecting waste toner is also supported by said supporting means.

4. The invention as set forth in claim 1, wherein said moving means comprises a tension spring and a solenoid cooperating appositively.

5. The invention as set forth in claim 1, wherein said means for cleaning said roller includes a first blade positioned to clean with said second blade riding over said roller when said roller is rotating in said counterclockwise direction, and a second blade positioned to clean with said first blade riding over said roller when said roller is rotating in said clockwise direction.

6. In an electrostatographic copier or printer that forms toner particle images and transfers them to a copy sheet by utilizing a moving photoconductor and a moving image transfer member in image transfer relationship with the photoconductor, a cleaning apparatus for removing residual particles from the surface of the photoconductor and the surface of the image transfer member, the cleaning apparatus comprising:

(a) a cleaning roller, mountable and rotatable about a shaft;
(b) means for applying a DC electrical bias to the surface of said roller;
(c) means for supporting said shaft and moving said roller into a first position for cleaning the photoconductor and into a second position for cleaning the image transfer member;
(d) a blade, connected to said supporting means for scraping the surface of said roller clean;
(e) a container, mounted to said supporting means and underneath said blade, for collecting waste toner particles;
(f) a tension spring connected to said supporting means for urging said roller into said first position;
(g) a solenoid connected to said supporting means for pivotally moving and holding said roller into said second position; and
(h) logic and control means connected to and controlling the action of said solenoid.

7. An electrostatographic copier or printer that forms toner particle images and transfers them to a copy sheet by utilizing a moving photoconductor and a moving intermediate image transfer member in image transfer relationship with the photoconductor, said copier or printer including a single cleaning apparatus having a cleaning element directly engageable against the surface of the photoconductor or against the surface of the intermediate image transfer member for removing residual particles from said surface of the photoconductor and said surface of the intermediate image transfer member.

8. The copier or printer of claim 7 wherein said cleaning element is a roller.

9. The copier or printer of claim 7 wherein said cleaning apparatus is selectively movable such that said cleaning element comes into direct cleaning engagement with said surface of the photoconductor or with said surface of the intermediate image transfer member.

10. An electrostatographic copier or printer that forms toner particle images and transfers them to a copy sheet of paper by utilizing a plurality of image bearing surfaces, said copier or printer including a single cleaning apparatus having a cleaning element directly and selectively engageable against a first image bearing surface or against at least a second image bearing surface for removing residual particles from each said first and at least said second image bearing surfaces.

* * * * *